US008888446B2

(12) United States Patent
Ali et al.

(10) Patent No.: US 8,888,446 B2
(45) Date of Patent: Nov. 18, 2014

(54) TURBOMACHINE ROTOR HAVING PATTERNED COATING

(75) Inventors: Sulficker Ali, Bangalore (IN); Vasanth Muralidharan, Bangalore (IN)

(73) Assignee: General Electric Company, Schenectady, NY (US)

( * ) Notice: Subject to any disclaimer, the term of this patent is extended or adjusted under 35 U.S.C. 154(b) by 545 days.

(21) Appl. No.: 13/269,036

(22) Filed: Oct. 7, 2011

(65) Prior Publication Data

US 2013/0089412 A1 Apr. 11, 2013

(51) Int. Cl.

| | |
|---|---|
| ***F01D 5/14*** | (2006.01) |
| ***F01D 5/28*** | (2006.01) |
| ***F01D 5/02*** | (2006.01) |
| ***F04D 29/16*** | (2006.01) |
| ***F04D 29/54*** | (2006.01) |
| ***F01D 11/00*** | (2006.01) |

(52) U.S. Cl.

CPC ..... *F01D 5/02* (2013.01); *F04D 29/164* (2013.01); *F04D 29/542* (2013.01); *F01D 11/001* (2013.01); *F05D 2230/90* (2013.01)

USPC ..... 415/174.4; 415/198.1; 416/224

(58) Field of Classification Search

USPC ..... 415/168.1–168.4, 170.1, 173.4, 173.5, 415/174.4, 174.5, 198.1, 224; 416/198 R, 416/199, 200 A, 201 R, 201 A, 198 A, 224

See application file for complete search history.

(56) References Cited

U.S. PATENT DOCUMENTS

| | | | | | |
|---|---|---|---|---|---|
| 899,319 | A | * | 9/1908 | Parsons | 415/173.5 |
| 953,674 | A | * | 3/1910 | Westinghouse | 415/173.6 |
| 1,999,739 | A | * | 4/1935 | Rasmussen | 416/174 |
| RE30,600 | E | * | 5/1981 | Long et al. | 277/414 |
| 4,477,089 | A | * | 10/1984 | Hoffman et al. | 277/414 |
| 4,867,639 | A | * | 9/1989 | Strangman | 415/173.4 |
| 5,364,543 | A | * | 11/1994 | Bosna et al. | 508/106 |
| 5,756,217 | A | * | 5/1998 | Schroder et al. | 428/469 |
| 6,012,723 | A | * | 1/2000 | Beeck | 277/355 |
| 6,077,035 | A | * | 6/2000 | Walters et al. | 415/115 |
| 6,203,021 | B1 | * | 3/2001 | Wolfla et al. | 277/415 |
| 6,457,939 | B2 | * | 10/2002 | Ghasripoor et al. | 415/174.4 |
| 6,499,943 | B1 | * | 12/2002 | Beeck et al. | 415/115 |
| 7,029,232 | B2 | * | 4/2006 | Tuffs et al. | 415/173.1 |
| 2003/0175116 | A1 | * | 9/2003 | Le Biez et al. | 415/173.4 |
| 2004/0126225 | A1 | * | 7/2004 | Ghasripoor et al. | 415/173.3 |
| 2004/0219010 | A1 | * | 11/2004 | Merrill et al. | 415/173.4 |
| 2006/0110247 | A1 | | 5/2006 | Nelson et al. | |
| 2006/0249911 | A1 | | 11/2006 | Kowalczyk et al. | |
| 2006/0269398 | A1 | * | 11/2006 | Marini et al. | 415/115 |
| 2009/0081028 | A1 | * | 3/2009 | Morgan et al. | 415/174.4 |
| 2009/0097970 | A1 | * | 4/2009 | Tholen et al. | 415/173.4 |
| 2009/0110550 | A1 | * | 4/2009 | Tani et al. | 415/199.2 |
| 2009/0208326 | A1 | * | 8/2009 | Durocher et al. | 415/134 |

OTHER PUBLICATIONS

U.S. Appl. No. 13/182,829, filed Jul. 14, 2011.

* cited by examiner

*Primary Examiner* — Ned Landrum
*Assistant Examiner* — Wayne A Lambert
(74) *Attorney, Agent, or Firm* — Hoffman Warnick LLC; Ernest G. Cusick

(57) ABSTRACT

A turbomachine rotor includes: a rotor body having an outer surface; and a patterned abrasive or abradable coating formed over the outer surface of the rotor body, the patterned abrasive or abradable coating for directing a flow of a working fluid across the turbomachine rotor.

11 Claims, 9 Drawing Sheets a

Side View

Top View

Front View

TURBOMACHINE ROTOR HAVING PATTERNED COATING

BACKGROUND OF THE INVENTION

The subject matter disclosed herein relates generally to turbomachine rotors having an abradable or abrasive patterned coating. More particularly, the subject matter disclosed herein relates to turbomachine rotors having abradable or abrasive pattern coatings applied over fluid-facing portions of the rotor, along with associated processes for applying such coatings.

Abrasive and/or abradable coatings have been applied to the surfaces of turbomachine rotors to increase the lifetime of the rotor's seal, and to further reduce radial clearances between components (e.g., rotor and stator components). Typically, metal or ceramic abradable seals are spray-coated onto the stationary seal surface, and are effective to establish a radial clearance of about 15 mils. While these coatings can be effective in reducing radial clearances, the coatings often fail to prevent undesirable flow patterns (e.g., swirls and/or tangential flows) at or near the rotating/stationary seal locations. These undesirable flow patterns can contribute to diminished turbomachine performance.

BRIEF DESCRIPTION OF THE INVENTION

A turbomachine rotor is disclosed. In one embodiment, the turbomachine rotor includes: a rotor body having an outer surface; and a patterned abrasive or abradable coating formed over the outer surface of the rotor body, the patterned abrasive or abradable coating for directing a flow of a working fluid across the turbomachine rotor.

A first aspect of the invention includes a turbomachine rotor having: a rotor body having an outer surface; and a patterned abrasive or abradable coating formed over the outer surface of the rotor body, the patterned abrasive or abradable coating for directing a flow of a working fluid across the turbomachine rotor.

A second aspect of the invention includes a turbomachine having: a stator; and a rotor at least partially housed within the stator, the rotor including: a rotor body having an outer surface; and a patterned abrasive or abradable coating formed over the outer surface of the rotor body, the patterned abrasive or abradable coating for directing a flow of a working fluid between the rotor and the stator.

A third aspect of the invention includes a turbomachine having: a stator having axially disposed sets of static nozzles; and a rotor at least partially housed within the stator, the rotor including: a rotor body having an outer surface; a plurality of rotor blades extending radially from the rotor body, the plurality or rotor blades and the sets of static nozzles interacting to form stages; and a patterned abrasive or abradable coating formed over the outer surface of the rotor body, the patterned abrasive or abradable coating for directing a flow of a working fluid within each of the stages.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
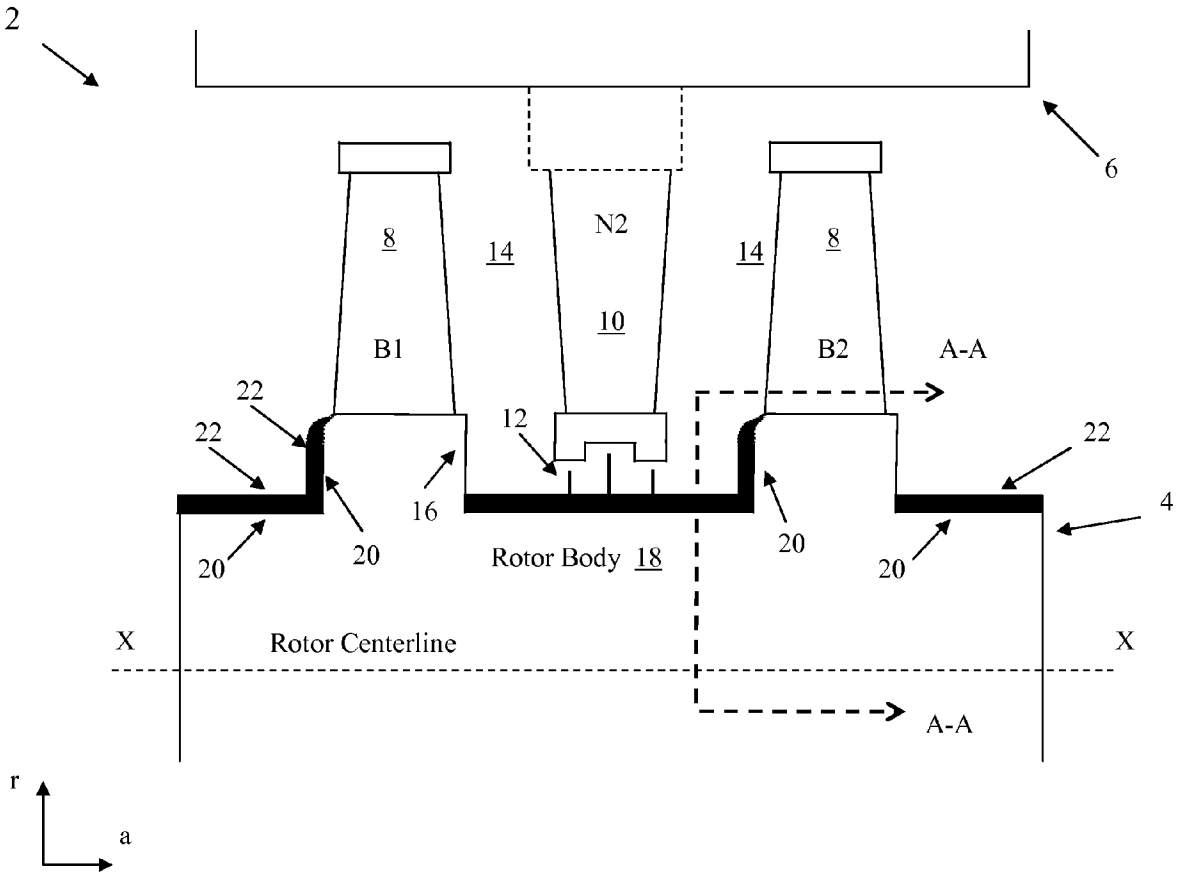
FIG. 1 shows a cross-sectional view of a portion of a turbomachine according to embodiments of the invention.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

The subject matter disclosed herein relates generally to turbomachine rotors having an abradable or abrasive patterned coating. More particularly, the subject matter disclosed herein relates to turbomachine rotors having abradable or abrasive pattern coatings applied over fluid-facing portions of the rotor, along with associated processes for applying such coatings.

As noted herein, abrasive and/or abradable coatings have been applied to the surfaces of turbomachine rotors to increase the lifetime of the rotor's seal, and to further reduce radial clearances between components (e.g., rotor and stator components). Typically, metal or ceramic abradable seals are spray-coated onto the stationary seal surface, and are effective to establish a radial clearance of about 15 mils. Additionally, coatings have been applied to static components of a turbomachine, including nozzle shrouds and seals, for the purposes of improving the aerodynamic performance of the turbomachine. While these coatings can be effective in reducing radial clearances, the coatings often fail to prevent undesirable flow patterns (e.g., swirls and/or tangential flows) at or near the rotating/stationary seal locations. These undesirable flow patterns can contribute to diminished turbomachine performance.

In contrast to the rotors coated with conventional abrasive and/or abradable coatings noted herein, aspects of the invention provide for a turbomachine rotor having an abrasive or abradable coating including one or more patterns therein. These patterns in the coating provide for increased control over leakage flow paths of the working fluid in the turbomachine. These coatings can be applied to the fluid facing surfaces of the turbomachine rotor to manipulate the leakage flow pattern of the working fluid across those fluid facing surfaces. These coatings are applied on the dynamic (e.g., rotating surfaces) of the turbomachine to help manipulate flow patterns of the working fluid, and additionally provide effective sealing against fluid leakage between stages of the turbomachine.

In one particular embodiment, a turbomachine rotor is disclosed including: a rotor body having an outer surface; and a patterned abrasive or abradable coating formed over the outer surface of the rotor body, the patterned abrasive or abradable coating for directing a flow of a working fluid (e.g., a secondary leakage flow) across the turbomachine rotor.

FIG. 1 shows a cross-sectional view of a portion of a turbomachine 2 according to embodiments of the invention. The turbomachine 2 can include a conventional steam turbine, gas turbine, fan/blower system, pump, etc. As shown, the turbomachine 2 can include a rotor 4 substantially surrounded/housed by a stator 6 (both only partially shown). The rotor 4 has a centerline X-X about which the rotor rotates when driven by the flow of working fluid across one or more rotor blades 8 (shown as blade 1, B1, blade 2, B2, etc.). As is know in the art, the rotor blades 8 are configured to intercept a flow of a working fluid (e.g., steam or gas), and drive rotation of the rotor 4 about its centerline X-X. The rotor 4 can be coupled (e.g., via a shaft) to another device (omitted for clarity) for converting this rotational motion into another form of motion/energy. As is also known in the art, the rotor 4 interacts with the stator 6, which has axially disposed sets of nozzles 10 (only one, N2, shown) having radially extending seals 12 (e.g., tooth seals). The combination of the nozzles 10 and seals 12 form turbine stages 14 (one shown) along the axial length of the turbobmachine 2, where the flow of the working fluid is directed through each stage via a set of nozzles 10 and seals 12. The flow of the working fluid through these turbine stages 14 is subject to a number of interruptions, one of which includes contact of the working fluid with a surface 16 of the body 18 of the rotor 4. In particular, the axially upstream-facing surfaces (or working-fluid-facing surfaces) 20 (shown directed toward the left-hand side of FIG. 1) of the rotor body 18 can disrupt the flow of the working fluid through one or more turbine stages 14, and impact performance of the turbomachine 2.

FIG. 1 illustrates the implementation of a patterned abradable or abrasive coating (or simply, patterned coating) 22 applied to the axially upstream-facing (or working-fluid facing) surfaces 20 of the rotor body 18. This patterned coating 22 can be applied to the rotor body 18 via a selective deposition technique, for example, using a spray gun and/or a masking/deposition method known in the art. The patterned coating 22 can include a pattern such as an adjacent tiled pattern, cross-hatching, separated tiling, milling, crimping, etc. A number of possible patterns will be shown and described herein, however, it is understood that these patterns are only illustrative examples of the manner in which these surfaces 20 of the rotor body 18 can be pattern-coated.

Figure 2:
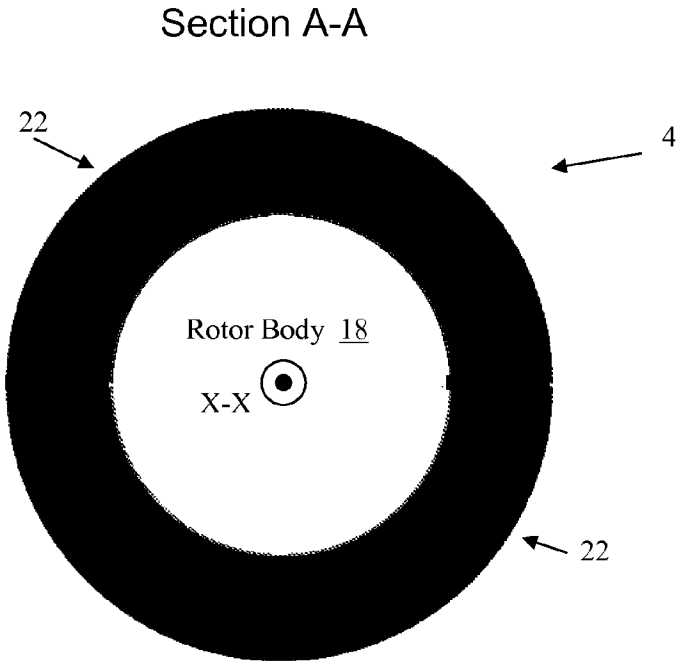
FIG. 2 shows a cross-sectional view of the rotor 4 of FIG. 1, cut along the section A-A.

FIG. 2 shows a cross-sectional view of the rotor 4 of FIG. 1, cut along the section A-A. As shown, the fluid-facing surfaces 20 (or axially upstream-facing surfaces) of the rotor body 18 are covered by the patterned coating 22. That is, the axially upstream-facing surfaces of the rotor body 18, as well as the radially outward facing surfaces of the rotor body 18, are covered by the patterned coating 22.

Figure 3:
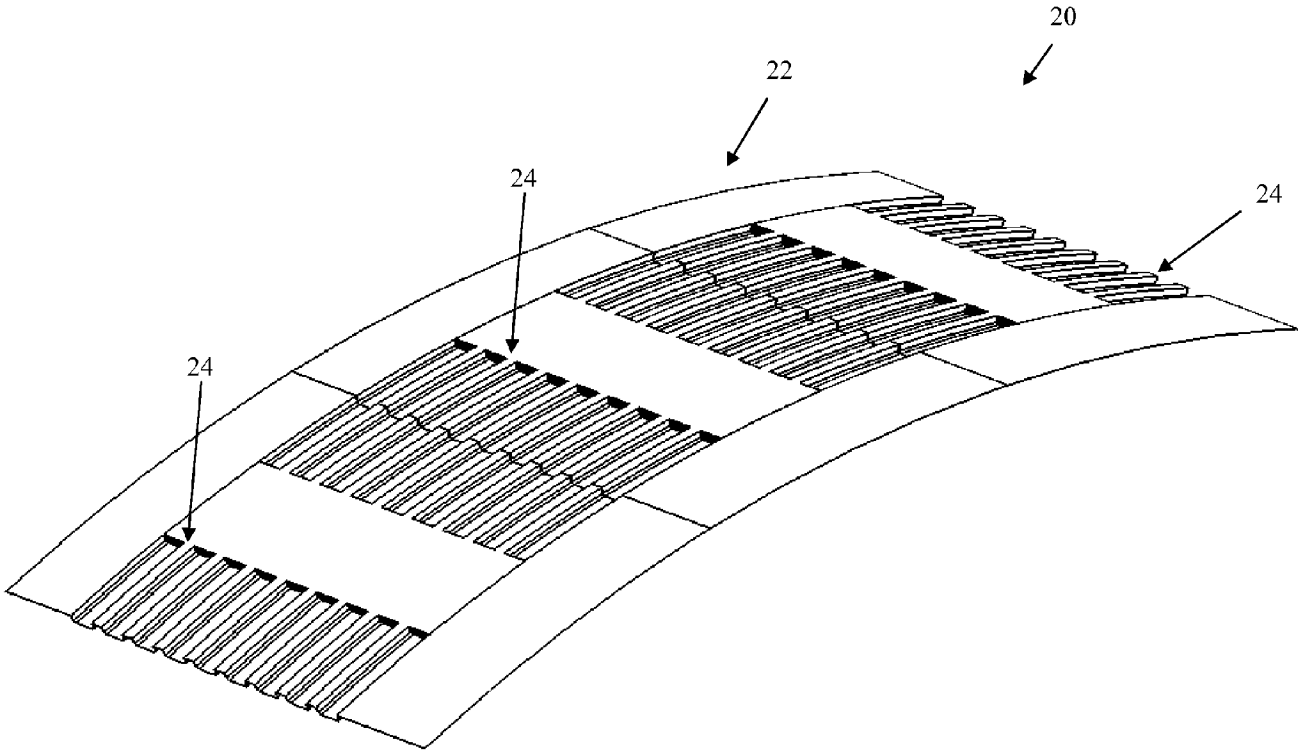
FIG. 3 shows a three-dimensional perspective view of a portion of the surface of the rotor of FIGS. 1-2.

FIG. 3 shows a three-dimensional perspective view of a portion of the surface 20 of the rotor 4 of FIGS. 1-2. This three-dimensional perspective view illustrates one type of patterned coating 22 possible for the rotor body (not shown). This pattern includes intermittent grooves (or troughs, or treads) 24 disposed axially along the coating 22. In some embodiments, these grooves 24 can be approximately 50 to 200 mills in depth, and can be separated from each other by approximately 100 to 200 mills in the axial direction. Further, sets of grooves 24 can be separated from adjacent sets of grooves 24 along the surface 20 by a distance of approximately 0.5 inches to 1 inch. In some cases, the grooves 24 can span approximately 10 degrees along the 360-degree circumference of the rotor body 18, and the separation between sets of grooves 24 can span approximately 5 degrees along the 360-degree circumference of the rotor body 18. It is understood that the intermittent patterning shown and described with reference to FIG. 3 is only one example of patterning that can be employed according to aspects of the invention. In some cases, the patterning can be dispersed continuously along one or more surfaces 20 of the rotor body 18.

Figure 6:
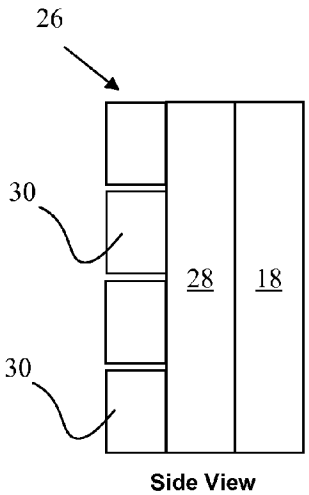
FIGS. 4-6 show a front, top and side view, respectively, of an anti-swirl pattern coating applied directly to the surface of a rotor body according to embodiments of the invention.
Figure 5:
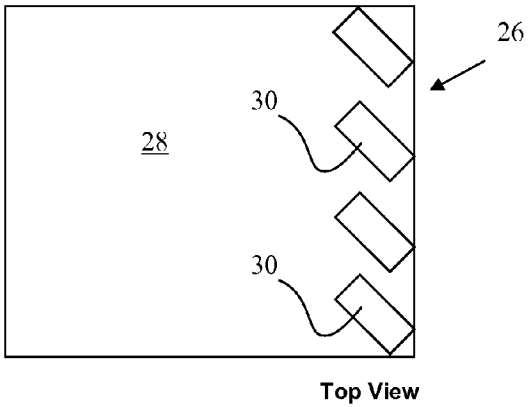
Figure 4:
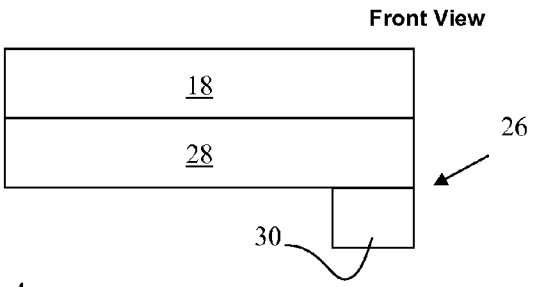

FIGS. 4-6 show a front, top and side view, respectively, of an anti-swirl pattern coating 26 applied directly to the surface of a rotor body 18. The anti-swirl pattern coating 26 in this case can include a base portion 28 and plurality of tangentially-aligned rectangular (or, block) segments 30 extending radially beyond the base portion 28. The pattern coating 26 can be applied directly to the rotor body 18 via any conventional methods.

Figure 9:
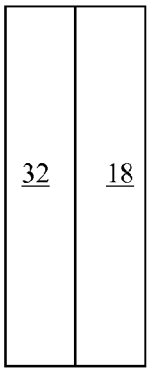
FIGS. 7-9 show a front, top and side view, respectively, of a meshed pattern coating applied directly to the surface of a rotor body according to embodiments of the invention.
Figure 8:
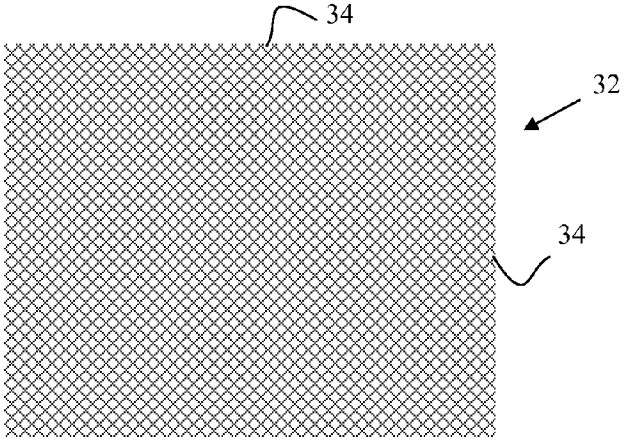
Figure 7:
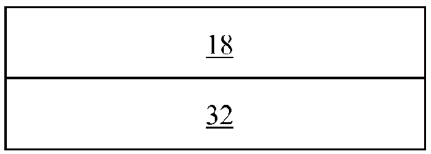

FIGS. 7-9 show a front, top and side view, respectively, of a meshed pattern coating 32 applied directly to the surface of a rotor body 18. The meshed pattern coating 32 in this case can include a single (or multiple layers) having a plurality of intersecting paths 34 extending therethrough. These paths 34 may form a mesh pattern as shown most clearly in FIG. 7. This meshed pattern coating 32 can be applied directly to the rotor body 18 via any conventional methods.

Figure 12:
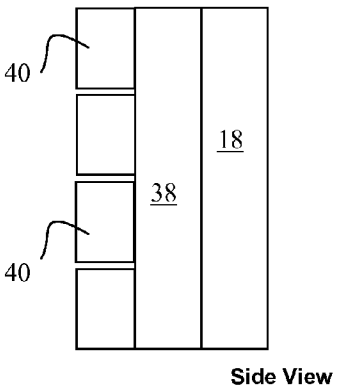
FIGS. 10-12 show a front, top and side view, respectively, of a double anti-swirl pattern coating applied directly to the surface of a rotor body according to embodiments of the invention.
Figure 11:
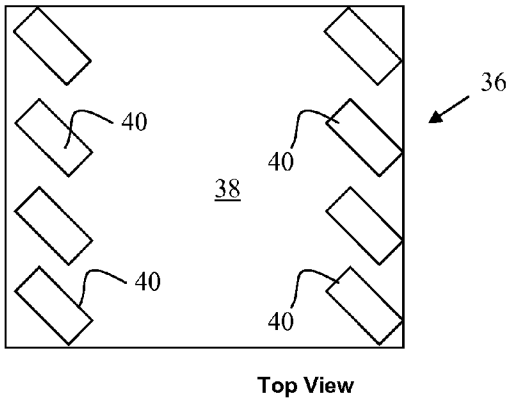
Figure 10:
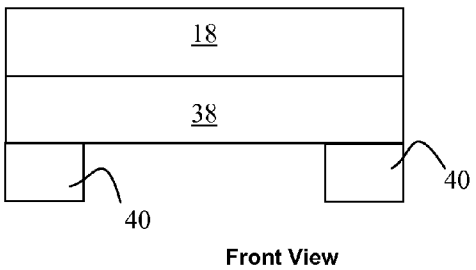

FIGS. 10-12 show a front, top and side view, respectively, of a double anti-swirl pattern coating 36 applied directly to the surface of a rotor body 18. The double anti-swirl pattern coating 36 in this case can include a base portion 38 and sets of tangentially-aligned rectangular (or, block) segments 40 extending radially beyond the base portion 38. These sets of tangentially-aligned rectangular segments 40 can be paired, such that a stage of the turbomachine (not shown) can include at least two sets of tangentially-aligned rectangular segments 40. These sets of tangentially-aligned rectangular segments 40 can run circumferentially along the outer surface of the rotor body 18, such that pairs of these include an axial upstream set and an axial downstream set. The double anti-swirl pattern coating 36 can be applied directly to the rotor body 18 via any conventional methods.

Figure 15:
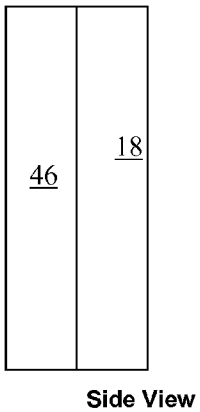
FIGS. 13-15 show a front, top and side view, respectively, of a channeled pattern coating applied directly to the surface of a rotor body according to embodiments of the invention.
Figure 14:
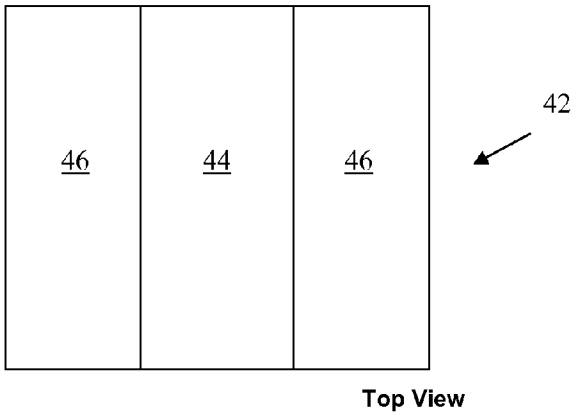
Figure 13:
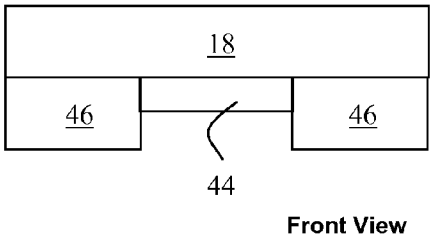

FIGS. 13-15 show a front, top and side view, respectively, of a channeled pattern coating 42 applied directly to the surface of a rotor body 18. The channeled pattern coating 42 in this case can include a single (or multiple layers) having a non-uniform topography. In particular, the channeled pattern coating 42 can include sections extending distinct radial distances from the surface of the rotor body 18. In one case, the channeled pattern coating 42 includes a central section 44 and two sidewall sections 46 abutting the central section. The channeled pattern coating 42 can be aligned such that a stage of the turbomachine (not shown) can include at least one central section 44 and two sidewall sections 46. The channeled pattern coating 42 can run circumferentially along the outer surface of the rotor body 18, such that the sidewall sections 46 are located axially upstream, and downstream, respectively, of their adjacent central section 44. This channeled pattern coating 42 can be applied directly to the rotor body 18 via any conventional methods.

Figure 18:
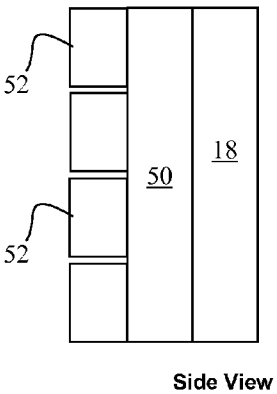
FIGS. 16-18 show a front, top and side view, respectively, of a staggered anti-swirl pattern coating applied directly to the surface of a rotor body according to embodiments of the invention.
Figure 17:
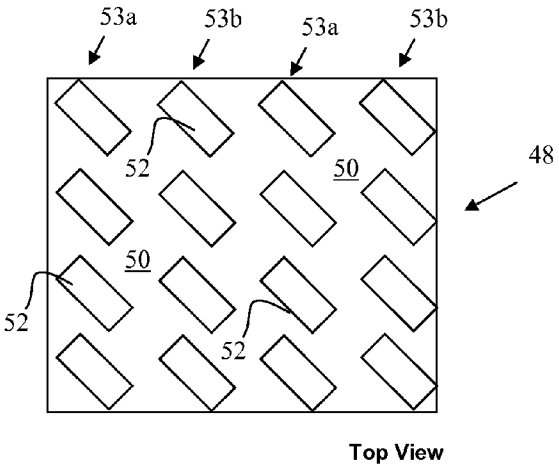
Figure 16:
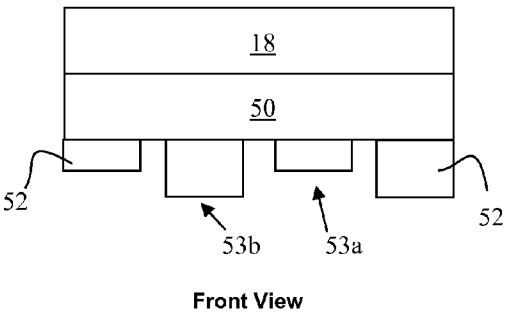

FIGS. 16-18 show a front, top and side view, respectively, of a staggered anti-swirl pattern coating 48 applied directly to the surface of a rotor body 18. The staggered anti-swirl pattern coating 48 in this case can include a base portion 50 and plurality of tangentially-aligned rectangular (or, block) segments 52 extending radially beyond the base portion 50. In some cases, the tangentially-aligned rectangular segments 52 can include axially adjacent rows 53*a*, 53*b* having distinct radial heights. The staggered anti-swirl pattern coating 48 can be applied directly to the rotor body 18 via any conventional methods.

Figure 21:
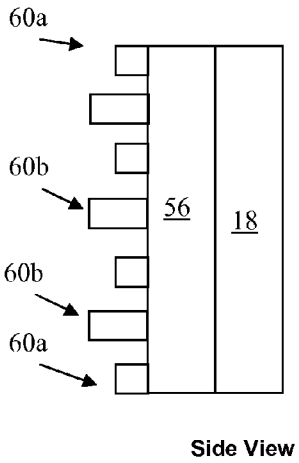
FIGS. 19-21 show a front, top and side view, respectively, of a staggered rectangular pattern coating applied directly to the surface of a rotor body according to embodiments of the invention.
Figure 20:
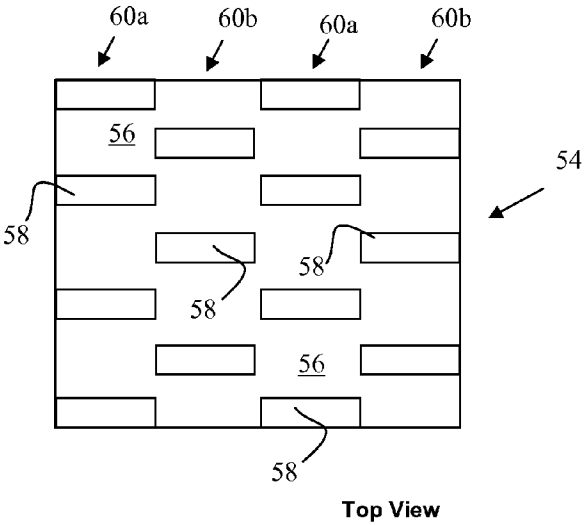
Figure 19:
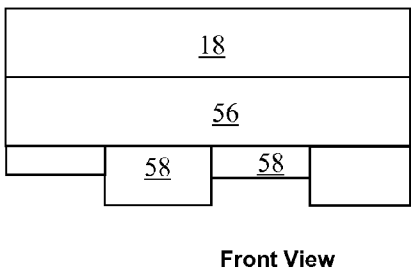

FIGS. 19-21 show a front, top and side view, respectively, of a staggered rectangular pattern coating 54 applied directly to the surface of a rotor body 18. The staggered rectangular pattern coating 54 in this case can include a base portion 56 and plurality of circumferentially staggered rectangular (or, block) segments 58 extending radially beyond the base portion 56. In some cases, the plurality of circumferentially staggered rectangular segments 58 can include axially adjacent rows 60*a*, 60*b* having distinct radial heights. The staggered rectangular pattern coating 54 can be applied directly to the rotor body 18 via any conventional methods.

Returning to FIG. 1, and with continuing reference to the figures herein, it is understood that aspects of the invention help to prevent leakage of fluid flow between adjacent stages (e.g., stages 14) in a turbomachine (e.g., turbomachine 2) and/or directing the leakage flow at a favorable angle to the main flow path. That is, the patterned abrasive or abradable coatings (e.g., coating 22) disclosed according to aspects of the invention help to minimize fluid leakage between axially disposed turbine stages, by directing fluid flow toward the turbine buckets 8. These patterned coatings help to disrupt the flow of working fluid across the surface 20 of the rotor body 18. This disruption can direct the flow of the working fluid radially outward (away from the rotor centerline). As such, the flow of the working fluid can be at least partially contained, or directed, within a particular stage 14 of the turbomachine 14. This manipulation of the flow of the working fluid allows a greater quantity of working fluid to impact the turbine buckets 8, creating a greater force on each turbine bucket 8 (thereby more efficiently utilizing the working fluid to drive the buckets 8). As the surface 20 of the rotor body 18 rotates with the rotor 4, these coatings can be patterned (e.g., as shown and described herein) to direct the fluid flow in a dynamic manner. That is, these patterned coatings can be designed to divert the flow of the working fluid where both the fluid is in motion, and the diverting surface (e.g., the coated surface 20) is in motion.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbomachine rotor comprising:

a rotor body having an outer surface, wherein the outer surface includes an upstream-facing portion and a downstream-facing portion; and a patterned abrasive or abradable coating formed over the outer surface of the rotor body, the patterned abrasive or abradable coating for directing a flow of a working fluid across the turbomachine rotor, wherein the patterned abrasive or abradable coating is formed over only the upstream-facing portion of the rotor body.

2. The turbomachine rotor of claim 1, wherein the outer surface includes an axially extending portion and a radially extending portion.

3. The turbomachine rotor of claim 1, wherein the patterned abrasive or abradable coating includes at least one of a continuous groove pattern, an intermittent groove pattern, an anti-swirl pattern, a meshed pattern, a double anti-swirl pattern, a channel pattern, a staggered anti-swirl pattern, or a staggered rectangular pattern.

4. A turbomachine comprising:

a stator; and a rotor at least partially housed within the stator, the rotor including:

a rotor body having an outer surface, wherein the outer surface includes an upstream-facing portion and a downstream-facing portion; and a patterned abrasive or abradable coating formed over the outer surface of the rotor body, the patterned abrasive or abradable coating for directing a flow of a working fluid between the rotor and the stator, wherein the patterned abrasive or abradable coating is formed over only the upstream-facing portion of the rotor body.

5. The turbomachine of claim 4, wherein the outer surface includes an axially extending portion and a radially extending portion.

6. The turbomachine of claim 4, wherein the patterned abrasive or abradable coating includes at least one of a continuous groove pattern, an intermittent groove pattern, an anti-swirl pattern, a meshed pattern, a double anti-swirl pattern, a channel pattern, a staggered anti-swirl pattern, or a staggered rectangular pattern.

7. The turbomachine of claim 4, further comprising a plurality of stages located axially along a length of the rotor, wherein the patterned abrasive or abradable coating at least partially contains the flow of the working fluid within each of the plurality of stages.

8. The turbomachine of claim 7, wherein the rotor includes a plurality of blades extending radially therefrom, and the stator includes axially disposed sets of static nozzles, wherein the sets of static nozzles define the plurality of stages.

9. A turbomachine comprising:

a stator having axially disposed sets of static nozzles; and a rotor at least partially housed within the stator, the rotor including:

a rotor body having an outer surface, wherein the outer surface includes an upstream-facing portion and a downstream-facing portion;

a plurality of rotor blades extending radially from the rotor body, the plurality or rotor blades and the sets of static nozzles interacting to form stages; and a patterned abrasive or abradable coating formed over the outer surface of the rotor body, the patterned abrasive or abradable coating for directing a flow of a working fluid within each of the stages, wherein the patterned abrasive or abradable coating is formed over only the upstream-facing portion of the rotor body.

10. The turbomachine of claim 9, wherein the outer surface includes an axially extending portion and a radially extending portion.

11. The turbomachine of claim 9, wherein the patterned abrasive or abradable coating includes at least one of an intermittent groove pattern, an anti-swirl pattern, a meshed pattern, a double anti-swirl pattern, a channel pattern, a staggered anti-swirl pattern, or a staggered rectangular pattern.

* * * * *